US005180128A

United States Patent [19]

Massey

[11] Patent Number: 5,180,128

[45] Date of Patent: Jan. 19, 1993

[54] PEGBOARD HOOK MOUNTING ASSEMBLY

[76] Inventor: Richard C. Massey, 102 Frontenac Forest, St. Louis, Mo. 63131

[21] Appl. No.: 760,900

[22] Filed: Sep. 17, 1991

[51] Int. Cl.[5] ..... A47F 7/00

[52] U.S. Cl. ..... 248/220.4; 248/221.1

[58] Field of Search ..... 248/220.4, 220.3, 221.1, 248/221.2

[56] References Cited

U.S. PATENT DOCUMENTS

| | | | |
|---|---|---|---|
| 3,339,871 | 9/1967 | Larson | 248/220.4 |
| 3,502,294 | 3/1970 | Kalbow et al. | 248/220.4 |
| 3,715,096 | 2/1973 | Filbert | 248/220.4 |
| 3,908,948 | 9/1975 | Hawthorne | 248/220.4 |

*Primary Examiner*—Alvin C. Chin-Shue
*Assistant Examiner*—Sarah A. Lechok
*Attorney, Agent, or Firm*—Paul M. Denk

[57] ABSTRACT

A pegboard hook or rod mounting assembly for use in combination with the pegboard having a plurality of holes, the assembly constructed of a two-part complementary component assembly consisting of a U-shaped mounting assembly, configured to fit within two or more holes of the peg board, and a rod like supporting member, which supports a variety of articles thereon, securely mates within the U-shaped mounting member, to snugly locate therein, and support the variety of packaged articles being displayed, or to hold a shelf suspended in place. Shifting of the rod support member can easily be performed, even if it contains and supports a variety of packaged articles, by merely shifting vertically, the entire support member, while it is maintained in a horizontal position, for ease of removal and relocation for holding within another U-shaped mounting member.

5 Claims, 2 Drawing Sheets

PEGBOARD HOOK MOUNTING ASSEMBLY

BACKGROUND OF THE INVENTION

This invention relates to a new and useful type of pegboard hook, generally formed as a pegboard hook mounting assembly, which facilitates the mounting of a variety and plurality of articles onto a pegboard, for display as during marketing, but conveniently and facilely allows for their shifting, upon the display, as desired.

Pegboard supports, of the type as normally used for commercial purposes, usually are formed as four by eight sheets of masonite, or the like, and include a plurality of holes that are spaced apart, generally, at one inch intervals. At present, pegs of various designs are inserted into the holes of the pegboard, to be used as hangers for supporting and displaying of articles. There is a problem, though, that exists with respect to the present designs of these pegs. Initially, when articles are located upon the pegs, usually any lower situated peg cannot be removed because of the obstruction caused by the upper pegs arranged in proximity therewith. Hence, unless some distance is provided between the location of the pegs, as supporting their plurality of articles, a lowermost peg is prevented from being pivoted upwardly, to provide for its disengagement from the pegboard, for its removal or relocation to another position. Normally, as known in the art, most of these pegboard anchoring devices require some pivotal movement of the hook, in order to disengage it from the pegboard. Usually that movement is in an upward direction, for some multitude of degrees, generally in the range of thirty to forty-five degrees, in order to attain its removal. But, when the hook is of the elongated type, and contains a variety of packaged articles thereon, such movement is just not easily accomplished, and normally cannot be accommodated. Other present designs for pegs for holding articles onto a pegboard necessitates a pivotal moving of the peg almost flush to the surface of the pegboard in order to attain a removal of the peg from the pegboard, or event to attain its insertion, for remounting of the hook, for further usage. Hence, this type of manipulation results in the expenditure of effort and time to remove or replace articles from the pegboard, reinsert the peg and replace the articles onto the hook, to accomplish a relocation of its supported articles for more convenient display.

Secondly, when a shelf is located directly above a peg, such pegs cannot be inserted into or removed from the pegboard without having to remove the shelf itself, unless the peg is located at a significant distance greater than the length of the peg itself. Hence, if it is a short type of hook or peg used in conjunction with the pegboard, then it only needs space equivalent to its length. But, if one looks at any routine display set forth in a hardware store, variety store, or the like, it can readily be seen that most of these hooks have some length, generally in the range of six to twelve inches, to accommodate the support of a plurality of packaged articles, and when the hooks or pegs are of this length, their removal is just not easily accomplished. The current invention is designed to remedy that problem.

Because of these demonstrated difficulties, the present invention of hooks or pegs, made in accordance with the teachings of this invention, allows for the insertion, removal, and repositioning of the hooks upon the pegboard with great ease and facility.

Examples of prior art are shown in the earlier patent to Florek, U.S. Pat. No. 4,928,912, discloses a pegboard hanger anchor design to stabilize a hanger within the pegboard. The structure of this patent requires that the hanger be attached to an anchor and that the legs extending from the attaching means be inserted into the pegboard, with feet like means that are adapted to abut the rear or back surface of the said pegboard.

The patent to Fahringer, U.S. Pat. No. 4,923,161, discloses a device for coupling hooks to a pegboard. In its structure, Fahringer includes a clip constituting one end of a screw which is fastened to the pegboard, and the clip receives and releasably retains the pegboard hook until the hook is physically withdrawn from the clip by overcoming the resilient retention forces of the clip. In this instance, the clip of Fahringer must be screwed into the pegboard, and then has to be unscrewed, in order to attain a removal of its pegboard hook. Hence, all of the articles mounted on the hook must be removed before the clip can be released.

The present invention differs from the prior art because it is a two-component complementary assembly that allows for the ease or removal of the pegboard supporting member from the pegboad without having to remove the articles from its elongated hook or rod. This is accomplished by simply raising or elevating the long-hook member, while maintained in a horizontal disposition, upwardly, from its supporting U-shaped member, which results in a substantial savings of time and effort in order to relocate displayed articles somewhere else upon the supporting pegboard, as during marketing. In addition, the same type of supporting members of this invention can potentially be used for supporting shelves, which could be freely moved on a pegboard, and provide easy transfer of supported articles, as when displayed, or stored.

SUMMARY OF THE INVENTION

The main purpose of this current invention is to provide a pegboard hooking means, which in this particular instance incorporates two parts, a U-shaped mounting member that can be applied to the pegboard, individually, with little interference with the surrounding articles, and once emplaced, can then support an elongated hook or rod like member that holds a variety of articles for display.

The subject matter of this invention includes the formation of U-shaped mounting means, which may be bent to various configurations, and includes bent ends at the legs of the means, so as to facilitate its removal or insertion with respect to the supporting pegboard. The mounting means cooperates matingly with the a rod like support means, which may be elongated, and can be inserted within mounting means, and snugly held therein so as to facilitate the stable support of any articles upon the elongated hook or rod like member, during usage and application. Then, as previously explained, since this invention is formed as a two-part member, the supporting means can be easily removed, without disruption to the supported articles, to allow access directly to the mounting means, so that it can be conveniently removed from the pegboard, shifted to another position, reinserted, when once again the elongated rod can be reinserted thereon, with the articles fully supported thereby, within a minimum of time and effort.

It is an object of this invention to provide a cost-effective system for the support and display of articles on a pegboard which provide for the flexibility of moving such pegs without having to first remove articles from the supporting rod, and then to relocate or reinsert the rod, upon its mounting means, with a minimum of effort.

A further object of this invention is to utilize the support means with its mounting hooks or rods in conjunction with the pegboard, and which can be used to support other items, such as shelves, or the like.

Yet another object of this invention is to provide means that are used in conjunction with the mounting means, so as to snugly embrace the mounting means of the rod supporting means, to provide stability in the holding of any articles to the pegboard, during its display or support.

These and other objects will become more apparent to those skilled in the art upon reviewing this summary of the invention, and upon a undertaking a study of the description of its preferred embodiment, in view of the drawings.

DESCRIPTION OF THE PREFERRED EMBODIMENT

The present invention provides major advantages over the prior art style of pegboard hooks. The two-component complementary assembly of this invention allows for the easy removal and relocation of the assembly without requiring the removal of any articles as supported upon the assembly. In addition, this assembly can be used for the support of shelves, or other items, that can be easily and freely moved and relocated upon the pegboard, thereby providing superior flexibility in the pegboard hook or shelving system of this invention. Thus, through usage of this invention, there is achieved a substantial savings of time, money, and manpower, during its usage and application, because of its enhanced flexibility and ease of reposition of the assembly during functioning.

Figure 1:
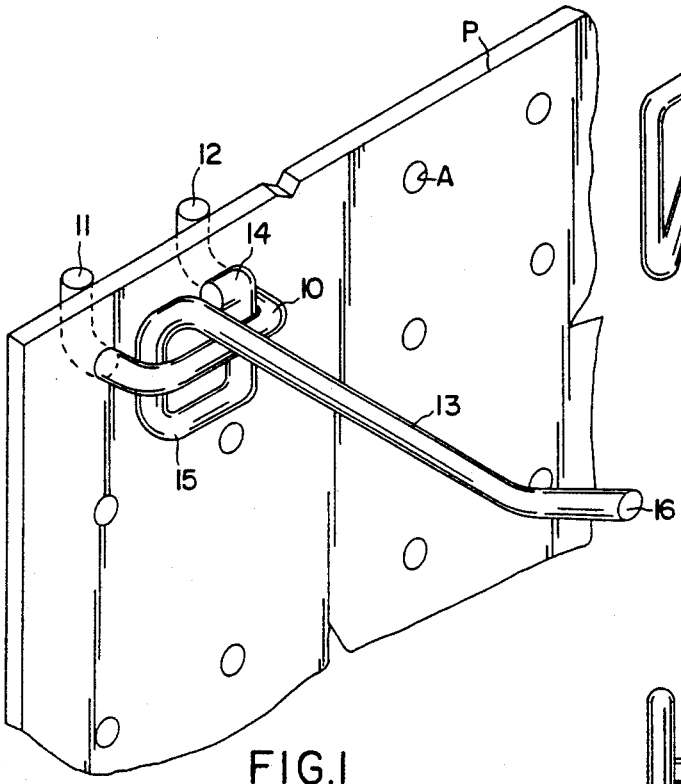
FIG. 1 is a partial isometric view of a pegboard, supporting the pegboard mounting assembly, and having the elongated member secured thereto for support of any packaged articles thereon.

In referring to the drawings, and generally in referring the embodiment as illustrated in FIG. 1, there is shown, partially, a sheet of pegboard material, as at P, and which is the type, as previously explained, is generally fabricated of a particular dimension, normally in the range of four by eight foot sheets, and having a series of apertures, as at A, provided therethrough, which normally are located at approximate one inch centers, during fabrication. The invention contemplates a two-part system, the first being a generally U-shaped mounting member 10, which incorporates integrally, at its two rearward ends 11 and 12, a bent configuration, generally upwardly, so as to facilitate the insertion and interfitting of the member 10 within two of the aligned pegboard apertures, as can be seen. The member 11 is designed to accommodate an inserting fit therein a long-hook or rod like support means 13, which at its base element, as at 14, is bent into a shape and configured to provide for its snug insertion within the spacing provided within the U-shaped mounting member 10, as can be seen. A part of the base extends downwardly, as at 15, and thereby is biased against the pegboard, and generally held flush therewith, by means of the member 10, once the long-hook or rod member 13 is inserted for application. As can be seen, the member 13 is elongated, as noted, and is bent slightly upwardly, as at 16, to provide a hook like retention of any articles thereon, once they are inserted for display, as during marketing. In the alternative, the member 13 may bend slightly downwardly, in order to facilitate the removal of articles therefrom.

Generally, as known in the art, frequently articles displayed for merchandising are packaged within some type of cellophane or other polymer container, and within their upper region include a hole, which is designed for accommodating and sliding on to the elongated portion 13, for support. Generally, a plurality of such packaged articles are mounted onto the long-rod member 13, and displayed for merchandising and which can be readily slid free thereof, by the purchaser, as desired.

Figure 2:
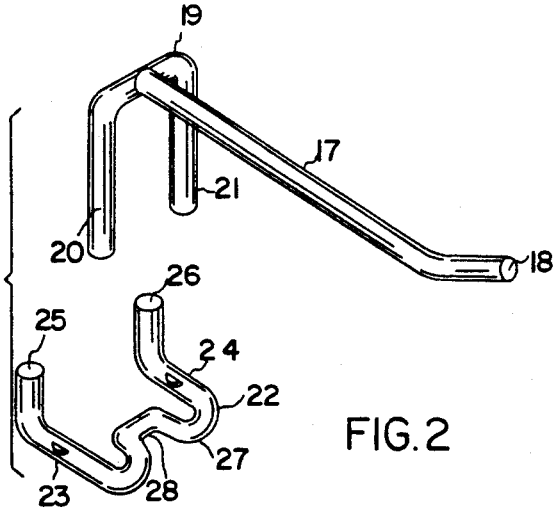
FIG. 2 is a view of another embodiment of the pegboard rod mounting assembly of this invention, showing the U-shaped mounting member in its position of support, with the rod like support member being elevated thereabove, but yet maintained horizontal in positioning, during its insertion or removal.
Figure 2A:
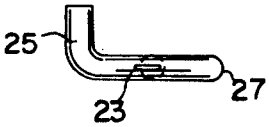
FIG. 2A is a side view of a slightly modified U-shaped mounting member of this invention, as shown in FIG. 2, showing how its frontal edge may bend downwardly to facilitate the insertion and holding of the rod like support member.

In referring to FIG. 2, the long-rod member 17 is constructed in a slightly different manner from the embodiment as previously described with respect to FIG. 1. In this instance, it comprises a length of rod 17, as can be seen, which once again, is bent upwardly, as at 18, at its forward end. The back end of the rod is secured, as by welding, soldering, or the like, to an inverted U-shaped member, as at 19, formed having a pair of depending legs 20 and 21, that extend downwardly for locating within the U-shaped supporting member 22. The member 22, while being shaped somewhat differently from that as previously explained at 10, is nevertheless functional in a manner similar thereto. For example, it includes an irregularly shaped member, having a pair of legs 23 and 24, which are bent upwardly, at their rearward locations, at 25 and 26, respectively, and which are integrally formed with a frontal cross bar, as at 27, which cross bar has an indentation, as at 28, formed therein, to cooperate with the base portion 19, of the hook like member, to support it once positioned. FIG. 2A provides a lateral view of a slightly modified U-shaped supporting member, as shown in FIG. 2. This discloses how the frontal edge 27 of the member may bend downwardly, as along its legs 23 and 24, and how the back ends of 25, 26 of the member extend perpendicularly upwardly, and thereby facilitate their insertion within the apertures of the pegboard P, while the frontal segment of the U-shaped supporting member, as explained, extends slightly downwardly, for facilitating the insertion and mating engagement with the base 19, of the elongated hook supporting member 17.

Figure 3:
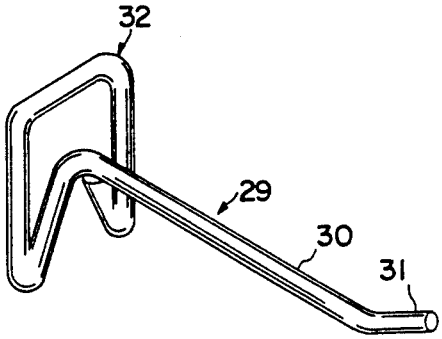
FIG. 3 is an isometric view of a further modification to the rod like supporting means of this invention, for use for holding a variety of packaged articles thereon.

FIG. 3 provides a view of an alternative shaped support means 29, which includes the elongated hook like rod 30, having is upturned end 31, with its base 32 being bent and configured to provide the means, as previously explained, for matingly inserting within a cooperating U-shaped supporting member, while at the same time, having sufficient dimension, both in height and width, and in depth, so as to snugly rest against the surface of the pegboard, to which it is mounted. Thus, in the same order as the supporting member of FIG. 1, the support member 30 can likewise matingly insert within the spacing provided by the U-shaped supporting member, of the type as shown at 10, or at 22, to conveniently hold a variety of articles for display upon the pegboard.

Figure 3A:
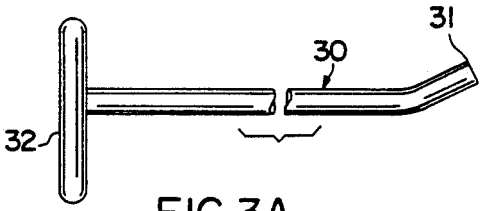
FIG. 3A is a side view of the member as disclosed in FIG. 3.

FIG. 3A provides a side view of the support member 30, which shows the various orientation between the location of the base 32, and its bent up forward portion 31, to reveal the length of the rod 30 and indicating the ample amount of supported articles that can be accommodated by the said member.

Figure 4:
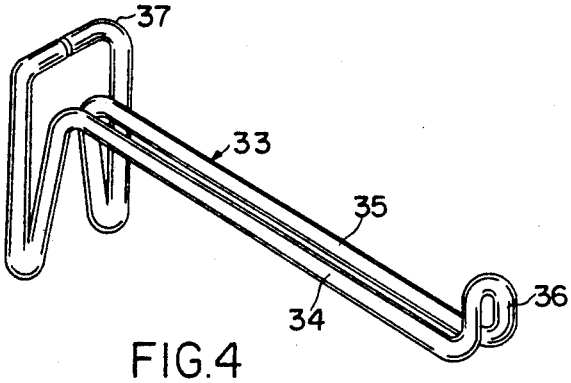
FIG. 4 is an isometric view of a further modification to the shaped hook or rod like support member of this invention, for use for supporting of articles.

FIG. 4 provides a view of a further embodiment for the rod like supporting member 33. As disclosed, the rod like member, in this instance, is bent and configured so as to provide a pair of elongated rods, as at 34 and 35, which are bent up at their forward end, as at 36, in the form of a hook, in order that once articles are inserted onto the double rod, they are adequately supported thereon, and prevented from untimely release by means of the member 36. The back end or base 37 of the rod is configured, as can be seen, to provide for its ease of insertion into a supporting member, of the type as previously described in FIGS. 1 and 2, and can be easily and matingly accommodated therein, but at the same time, may be quickly removed, by simply raising the member 33 upwardly, so as to clear the U-shaped supporting member, and to allow for transfer of the entire article supporting rod means, to another location, as desired.

Figure 4A:
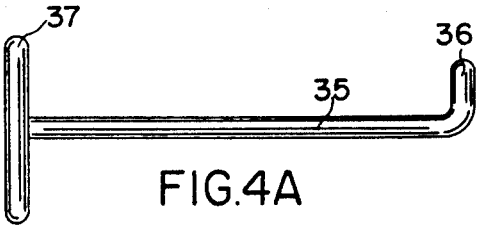
FIG. 4A is a side view of the member of FIG. 4.

FIG. 4A provides an additional side view of the various components that are integrally formed into the shape of the rod supporting member as disclosed and described in FIG. 4.

Figure 4B:
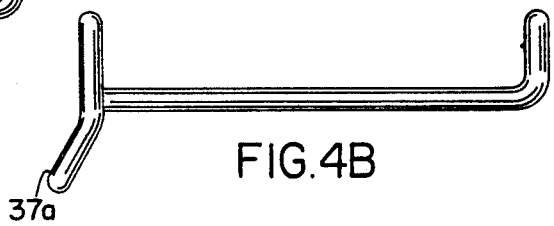
FIG. 4B is a side view of a modification to the rod support member of this invention, showing the lower segment of the base being bent inwardly for stability during mounting.

As can be seen in FIG. 4B, the lower segment of the base 37 may be bent inwardly, as noted at 37A, so that once the supporting means is inserted within the U-shaped mounting member, the cant of the base 37 will be snugly biased against the surface of the contiguous pegboard, to fully support the rod supporting means 35 at an approximate perpendicular angle forwardly of the said pegboard.

Figure 5A:
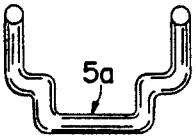
FIG. 5A is a top view of the member of FIG. 5.
Figure 5:
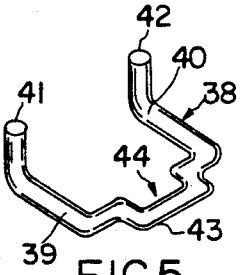
FIG. 5 is a isometric view of a further modified U-shaped supporting member of this invention.

FIG. 5 is a view of a further modification to a U-shaped mounting member 38 of this invention. Its function is similar to that of the members previously described, and includes a pair of legs, as at 39 and 40, with bent up tabs 41 and 42, respectively, in order to accommodate their insertion and hold of the member within the pegboard, once installed. Formed integrally forwardly of the member 38 is at integrally forwardly extending brace, as at 43, and the U-shaped mounting member, as disclosed and described herein, may obviously accommodate bases of differing sizes for select rod like supporting members, of the type as previously described in FIGS. 1, 3, and 4 of this disclosure. For example, the upturned ends 41 and 42 may insert through alternate holes within the pegboard, and be wider in configuration than the standard one as shown in FIG. 1. Thus, it may accommodate a much wider form of rod supporting member, as explained, or it may support the standard width type, as shown in FIG. 1, that may insert and be accommodated within the narrower spacing, as disclosed at 44, formed as a result of the bent configuration for the member, as can be seen. The relationship of the spacing 44 is more adequately disclosed at 5a in FIG. 5A.

Figure 6:
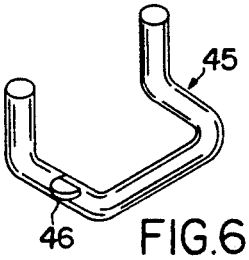
FIG. 6 is a isometric view of a further modified U-shaped supporting member of this invention.
Figure 6A:
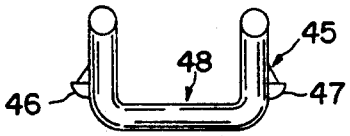
FIG. 6A is a top view of the member of FIG. 6.

FIGS. 6 and 6A disclose a further variation upon the U-shaped mounting means of this invention. In this instance, the member 45 is generally bent and shaped into the configuration of the member 10 as previously explained with regard to FIG. 1. But, in this instance, there are some extending ears, as at 46 and 47, and which prevent the two inwardly insertion of the member as it is located through the apertures A of the pegboard P. As can be seen in FIG. 6A, the ears may have a particular configuration, having a canted rearward segment, so as to bind within the apertures of the pegboard, and assure the tight retention of the member thereto. Furthermore, this assures that there is adequate clearance, in the vicinity of the spacing 48, into which the base of any rod supporting means may insert, so as to make it easier for the clerk to insert, or remove, the rod supporting member, as it is being shifted in its display.

Figure 7:
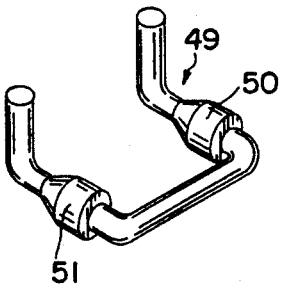
FIG. 7 is an isometic view of a further modified U-shaped supporting member of this invention.
Figure 7B:
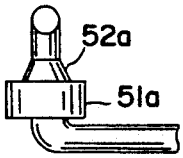
FIG. 7B is a top view of a slight modification to the bumper used in conjunction with the U-shaped supporting member.
Figure 7A:
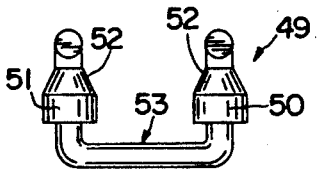
FIG. 7A is a top view of the member of FIG. 7.

FIGS. 7 and 7A disclose a further variation upon the U-shaped mounting means, and in this particular instance, the member 49, is fabricated and bent, once again, similar to that as shown at 10 in FIG. 1, but in this particular instance, has a pair of resilient type bumpers, as at 50 and 51, provided thereon, and for a twofold purpose. Initially, at their tapered ends, as illustrated at 52, they limit the extent of insertion of the supporting member 49 into the apertures of the pegboard, once installed. But furthermore, the resiliency of these bumpers provide adequate clearance, as at 53, to accommodate the snug insertion of the base of any rod supporting member therein, while at the same time, have a tendency to cushionly bias against the sides of any base, to assure its snug retention within the supporting member, and to prevent its untimely shifting or rattling, particularly when a customer is manipulating an article from the display. These bumpers 50 and 51 may be fabricated of any resilient material, such as a polyurethane, rubber, or other polymer, and provide a slight cushioning against the base of any rod support member as it is inserted and held therein. As can be seen in FIG. 7B, the bumper is slightly revised in design, and includes a tapered portion, at 52A, to assure the tight retention of the supporting member within the apertures of the pegboard, but that the frontal portion 51A of the bumper is shifted forwardly in proximity with the front of the supporting member, so that when the legs, such as the legs 20 and 21 of the rod like member are inserted therein, they will be tightly biased between the bumpers 51A, to assure a snug retention of the rod support member therebetween, as distinct from what is shown in FIGS. 7 and 7A.

As previously explained, the purpose of this invention is to provide a two part U-shaped member, that cooperates for snugly holding rod supporting members in place, once a variety of articles have been located thereon. As is well know, and as previously explained, usually articles displayed for sale are packaged in some form of small containers, have a form of slot or opening provided proximate its upper marginal edge, and which are slid onto the rod portions of the support members, whereby a plurality of them may be displayed for sale, and as the customer desires one or more of the same, can simply slide any packaged article forwardly, slightly shifted upwardly, to free it from the hook like portion of the support members, for removal. Furthermore, since there is little or no friction that is generated between the rod support member, and the U-shaped mounting member, with the exception of what slight cushioning resistance is afforded by means of the bumpers, such as the members 50 and 51, the entire rod support member, with its contained packaged articles, can be easily removed, by simply shifting the entire rod support member vertically, for removal to another location, and for reinsertion within another U-shaped mounting member, as desired and required.

In addition to the foregoing, as previously alluded to, it is likely that shelves may be supported by the more rigid rod support members, such as that as shown at 33 in FIG. 4, also for display of merchandise upon a pegboard, or even for use in the home as may be desired and required.

Variations or modifications to the subject matter of this invention may occur to those skilled in the art upon reviewing disclosure of this invention as provided herein. Such variations or modifications, if within the spirit of this invention, are intended to be encompassed within the scope of any claims to patent protection issuing upon this development. The description of the preferred embodiment as provided herein, and illustrated within the drawings, is done so for illustrative purposes only.

Having thus described the invention what is claimed and desired to be secured by Letters Patent is:

1. Pegboard hook mounting assembly for use in combination with a pegboard having a plurality of holes, such assembly constructed and arranged as a means for accommodating the support of articles from the application of such assembly, said assembly comprising a two-piece complementary component assembly consisting of an approximate U-shaped mounting means configured to fit into at least two holes of a pegboard, and a supporting member which matingly and releasably inserts within the U-shaped member, said supporting member comprising a long rod-like member useful for holding a plurality of articles thereon, said supporting member being securely engaged and firmly positioned upon its mating within the U-shaped mounting means, with said supporting member having a base that extends downwardly therefrom, for biasing against the pegboard to form support with the U-shaped mounting means to hold the articles supported thereon, said U-shaped mounting means is complementary shaped so as to provide for its connection within the holes of the pegboard during its installation, and integral tabs provided upon the U-shaped mounting means to limit the extent of its insertion within the holes of the pegboard during its installation.

2. The invention of claim 1 and wherein said U-shaped mounting means incorporating a frontal cross bar, said cross bar having an extending indention provided therein, wherein differing sized bases formed of the supporting member may be accommodated by the U-shaped mounting means for accommodating the support of at least one article upon its rod-like member.

3. The invention of claim 1 and including wedging means mounting upon the U-shaped mounting means and cooperating to hold the supporting member thereon when its base is matingly inserted with said U-shaped member.

4. The invention of claim 3 and wherein said wedging means comprising resilient bumpers mounted upon said U-shaped mounting means, for wedging the base of the supporting member between the said wedging means and the proximate U-shaped mounting means when the supporting member is inserted within the U-shaped mounting means for holding an article supported thereon.

5. The invention of claim 1 and wherein said base having a downward segment, and said downward segment forming a downwardly extending angled portion that functions to facilitate the wedging of the supporting member within the mounting means and against the pegboard.

* * * * *